US005152334A

United States Patent [19]

Gallucci

[11] Patent Number: 5,152,334

[45] Date of Patent: Oct. 6, 1992

[54] GUIDE ROLL ASSEMBLY AND METHOD OF GUIDING CAST STRAND

[75] Inventor: Frank Gallucci, North Huntingdon, Pa.

[73] Assignee: Mesta International, Pittsburgh, Pa.

[21] Appl. No.: 517,859

[22] Filed: May 2, 1990

[51] Int. Cl.[5] ..... B22D 11/12

[52] U.S. Cl. ..... 164/484; 164/442; 164/448

[58] Field of Search ..... 164/484, 448, 447, 442, 164/441

[56] References Cited

U.S. PATENT DOCUMENTS

| | | | |
|---|---|---|---|
| 3,409,070 | 11/1968 | Ciochetto | 164/442 X |
| 3,891,025 | 6/1975 | Bollig et al. | 164/448 X |
| 4,007,822 | 2/1977 | Scheurecker | 164/448 |
| 4,038,856 | 8/1977 | Bayer et al. | 164/448 X |
| 4,079,777 | 3/1978 | Scheurecker et al. | 164/484 X |
| 4,096,907 | 6/1978 | Krall et al. | 164/448 |

*Primary Examiner*—J. Reed Batten, Jr.
*Attorney, Agent, or Firm*—Armstrong & Kubovcik

[57] ABSTRACT

A guide roll assembly associated with a continuous caster supports both faces of a dimensionably unstable metal strand at it solidifies and cools. A frame segment has a first frame member operatively connected with movable second frame member. The first frame member supports first guide rolls and stops. The second frame member supports second guide rolls and also rotatable cams. An anchor clamped with the stops, anchors the cams to the first frame member when a piston cylinder clamps the anchor against the first frame member to establish a nominal roll gap dimension. Motors rotate the cams to reposition the second frame member and the second guide rolls mounted on it and thereby adjust the nominal roll gap dimension. Frame segments can be oriented by camming to provide a taper line to contact both faces of a shrinking strand or to perform a soft reduction upon it.

18 Claims, 5 Drawing Sheets

GUIDE ROLL ASSEMBLY AND METHOD OF GUIDING CAST STRAND

BACKGROUND OF THE INVENTION

This invention relates to a guide roll assembly for guiding solidifying metal strand traveling from a casting mold. It also relates to a method of guiding a solidifying length traveling from a casting mold.

In continuous processes for producing steel and other metals into flat products having thicknesses of from about 250 mm (10 inches) or more down to about 150 mm (6 inch) or less, liquid metal is poured into a casting mold where a thin metal skin forms adjacent the mold wall. A continuous metal strand having a skin surrounding a liquid core then travels from the casting mold and through guide roll assembly while the strand continues to solidify and cool down to lower temperatures suitable for further handling and processing. The traveling solidifying lengths are inherently dimensionally unstable because the cores are in or near their melting ranges and also because metals tend to shrink as they solidify and cool. In addition, metals which undergo solid phase change when cooling may shrink at significantly different rates as they cool. For example, a carbon steel strand may shrink up to 5% or more while traveling from a mold to the next processing step. If the strand shrinks to a thickness less than the roll gaps between the guide rolls, then both sides of a strand may not be sufficiently supported by the guide rolls and the traveling strand may move between the guide rolls. In addition, the various processing operations and handling apparatus also create forces on the strands. For example, there may be a substantial static head of liquid metal in the strand core in typical casting operations which must be opposed by the thin strand walls. If the strand is not sufficiently supported by the guide roll assembly, the strand surface may bulge or develop waves which adversely affect its shape or profile. Also, any uncontrolled movements of the strand which causes the liquid metal core to flow relative to the skin may affect the solidification mechanism and thereby degrade the internal metallurgical quality of the strand.

In addition to product quality, the liquid metal in the core of a solidifying strand length which is not suitably supported may cause internal or external fractures of the strand and shut down the casting line or cause other process difficulties.

In order to support both faces of solidifying strand lengths, the art sometimes during a maintenance cycle adjusts spacers between opposed pairs of guide rolls of a guide roll assembly to present a taper line defined by a series of progressively narrowing guide roll gaps to correct for the estimated shrinkage of the particular metal about to be cast. This usually is very time consuming because there are many frame segments supporting the guide rolls which must be unlocked, shimmed and locked up. Frequently the taper line does not sufficiently correct for shrinkage because the processing conditions change over the course of a casting campaign. Also it has been proposed by several others in the art to improve product quality by adjusting the thicknesses of spacers between frame members of guide roll segments in order to effect a soft reduction of about 0.02% upon a solidifying strand length in the last stage of solidification, which would be very difficult to accurately and consistently locate even with the assistance of a modern computing device. More versatile guide roll assemblies have not been developed because the type of devices which would normally be employed to position the guide rolls require relatively large spaces in which to operate but there is very little space around a guide roll assembly to accommodate such devices and their appurtenant equipment. Also the hostile environment surrounding a metal strand requires increased maintenance of instrumentation and control systems and reduces their reliability.

SUMMARY OF THE INVENTION

A guide roll assembly embodying the present invention may be employed to readjust the nominal roll gaps of opposed pairs of guide rolls before or while a strand is traveling through the guide roll assembly. It has a simple structure which is reliable and needs little maintenance. Opposed pairs of first and second guide rolls are mounted on generally opposed first and second frame members respectively. Preferably the first and second frame members are operatively connected members of a frame segment which supports a plurality of opposed pairs of guide rolls at least one of which is a pinch roll pair. Thus, in a preferred embodiment of the present invention, the second guide roll of the pinch roll pair is preferably movable relative to the opposed first guide roll and to the other guide roll pairs during a casting campaign for driving a starting bar or a strand. Most preferably there ar several of these frame segments along the pass line.

The second frame member is movable relative to the first frame member. The first frame member has stops for stopping the approaching movement of the second frame member. A plurality of anchors and frame clamping means operatively connect the first and second frame members. Each anchor has a stop engaging means for engaging one of the first frame member stops and has a cam engaging means for anchoring a cooperating cam rotatably mounted o the second frame member to the first frame member. The frame clamping means are operatively connected with the anchors and the first frame member for urging the stop engaging means against the stops and thereby positioning the second frame member relative to the first frame member and establishing a nominal roll gap dimension between the opposed pair of guide rolls mounted on them. Cam rotating means are operatively connected with the cams mounted on the second frame member for rotating the cams to reposition the second frame member and the guide roll(s) mounted on it relative to the first frame member and to the roll(s) mounted on it and thereby to adjust the nominal roll gap dimension.

In the practice of the present invention, the nominal roll gap dimension of each guide roll pair is established by urging the stop engaging means of the anchors against the stops of the first frame member to position the second frame member and its second guide roll(s) relative to the first frame member and its guide roll(s). The first frame member may in some embodiments be movable as well. The nominal roll gap dimension is then adjusted by rotating the cams, which are mounted on the second frame member and anchored to the first frame member, to cam the second frame member and its guide roll(s) relative to the first frame member and its guide roll(s). The roll gap(s) may be adjusted for contacting both faces of a solidifying shrinking strand to support or to softly reduce the strand or to roll a solidified strand near its mushy range.

Other details, objects and advantages of the present invention will become apparent as the following description of a presently preferred embodiment proceeds.

BRIEF DESCRIPTION OF THE DRAWINGS

In the accompanying drawings, a presently preferred embodiment o the present invention is shown in which.

DETAILED DESCRIPTION OF A PREFERRED EMBODIMENT

Figure 1:
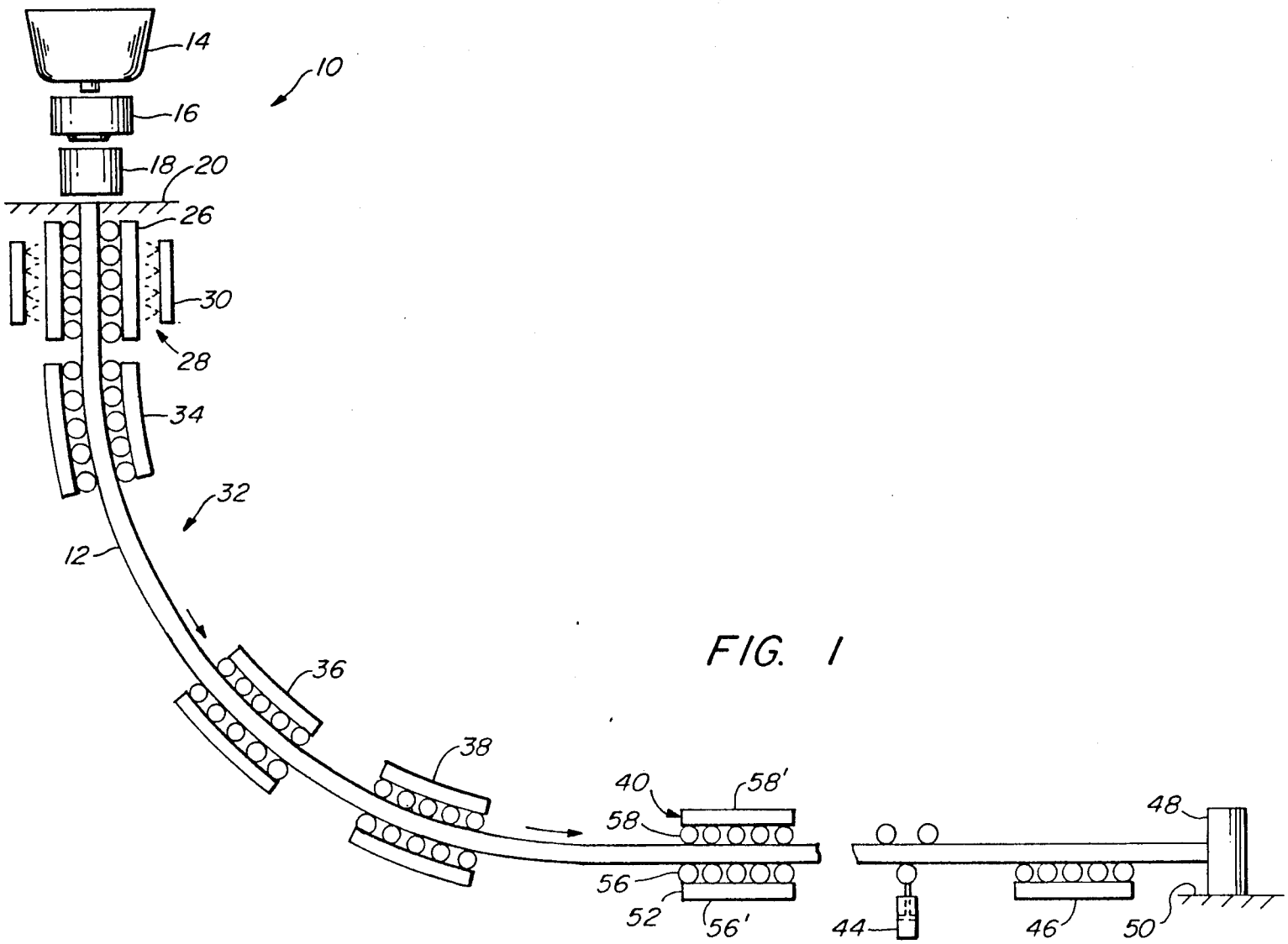
FIG. 1 is a schematic representation of a continuous caster and guide roll assembly with which the present invention may be employed for producing flat metal products.

FIG. 1 generally depicts a vertical continuous caster 10 for casting a steel strand 12 having a nominal thickness of about 250 mm (10 inches). A ladle 14 pours liquid metal into a tundish 16 which distributes the liquid metal to a stationary casting mold 18 located on a casting level 20. The metal in the mold 18 adjacent the mold wall begins to form a strand 12 having a thin skin 22 (shown in FIGS. 2, 5 and 6) surrounding a liquid metal core 24. The partially solidified strand 12 travels from the casting mold 18 through an adjacent quick change guide roll rack 26 in a secondary cooling section 28 where the strand 12 is sprayed with water, or a mixture of air and water by spray devices 30. As is schematically depicted in FIG. 1 the strand 12 then travels through a guide roll assembly 32 comprising several frame segments 34, 36, 38, 40 embodying the present invention. The guide roll assembly 32 is shown as including a vertically disposed frame segment 34, a plurality of inclined frame segments 36, 38 and a horizontally disposed frame segment 40. The strand 12 is bent by the arrangement o the rolls of the guide roll assembly 32, straightened by a straightening mechanism 44 and transferred by a roll table 46 to a cut-off device such as a torch 48 on a lower level 50 below the casting mold 18. The present invention may also be advantageously employed with generally horizontal casting operations where the metal is cast on one floor level.

As FIG. 1 depicts, each of the frame segments 34, 36, 38, 40 embodying the present invention generally has a first frame member 52 and a second frame member 54 which support at least one (and preferably at least two) pair of opposed guide rolls. As shown, each frame segment 34, 36, 38, 40 supports five guide roll pairs. Thus, five first guide rolls 56 are mounted on the first frame member and are spaced from generally opposed five second guide rolls 58 mounted on the second frame member 54.

Preferably one of the pairs of guide rolls are pinch rolls, including a first guide roll 56' and a second guide roll 58', for driving starter bars (not shown) and the strand 12 through the guide roll assembly 32. In the guide roll assembly 32 shown, the third pair of guide rolls of each frame segment 34, 36, 38, 40 are pinch rolls and the other pairs of guide rolls are idler rolls.

FIGS. 2–6 generally show the structure of the horizontally disposed frame segment 40 depicted in FIG. The other frame segments 34, 36, 38 shown in FIG. 1 are similar to the horizontal frame segment 40 and will not be discussed further. The partially solidified strand length 12 is shown travelling through a roll gap 60 defined by a first guide roll 56 and a second guide roll 58.

Figure 3:
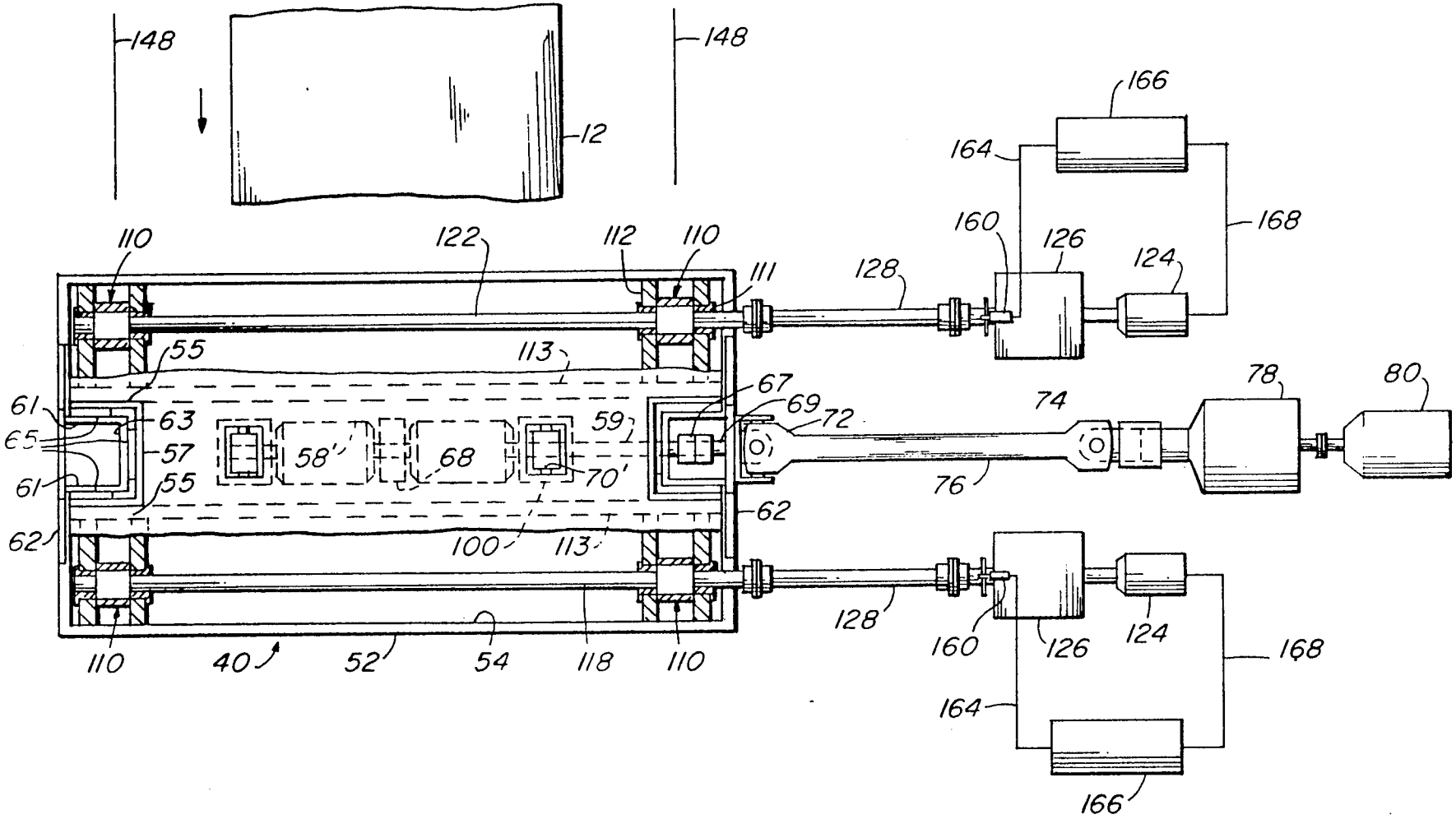
FIG. 3 is a partial sectional view of the guide roll assembly of FIG. 2 generally taken along line 3—3 (with the piston-cylinder assembly removed for purposes of clarity)

The frame segment 40 shown has a stationary first frame member 52 and a second frame member 54 which is movable relative to and guided by the first frame member 52. Thus the first frame member 52 has legs (not shown) conventionally attached to a segment carrier (not shown). As is shown in FIG. 3, the first frame member 52 has end guides 62 with attached guiding members 61, 63 supporting bronze wear pads 65. The second frame member 54 includes generally vertical contact plates 55, 57 which slide against the wear pads 65 as the second frame member 54 moves.

The guide rolls 56, 58 are rigidly mounted on the frame members 52, 54. Thus the faces of first and second guide rolls 56, 58 are preferably split to accommodate intermediate bearing supports 68 for rolling high strength metals of widths of up to 2000 mm or more. Depending upon the metal, its width and thickness, full faced guide rolls (not shown) without intermediate supports may be employed. The first guide rolls 56 (and their intermediate and end bearing supports 68, 70) are identical to each other and to the second guide rolls 58.

Figure 6:
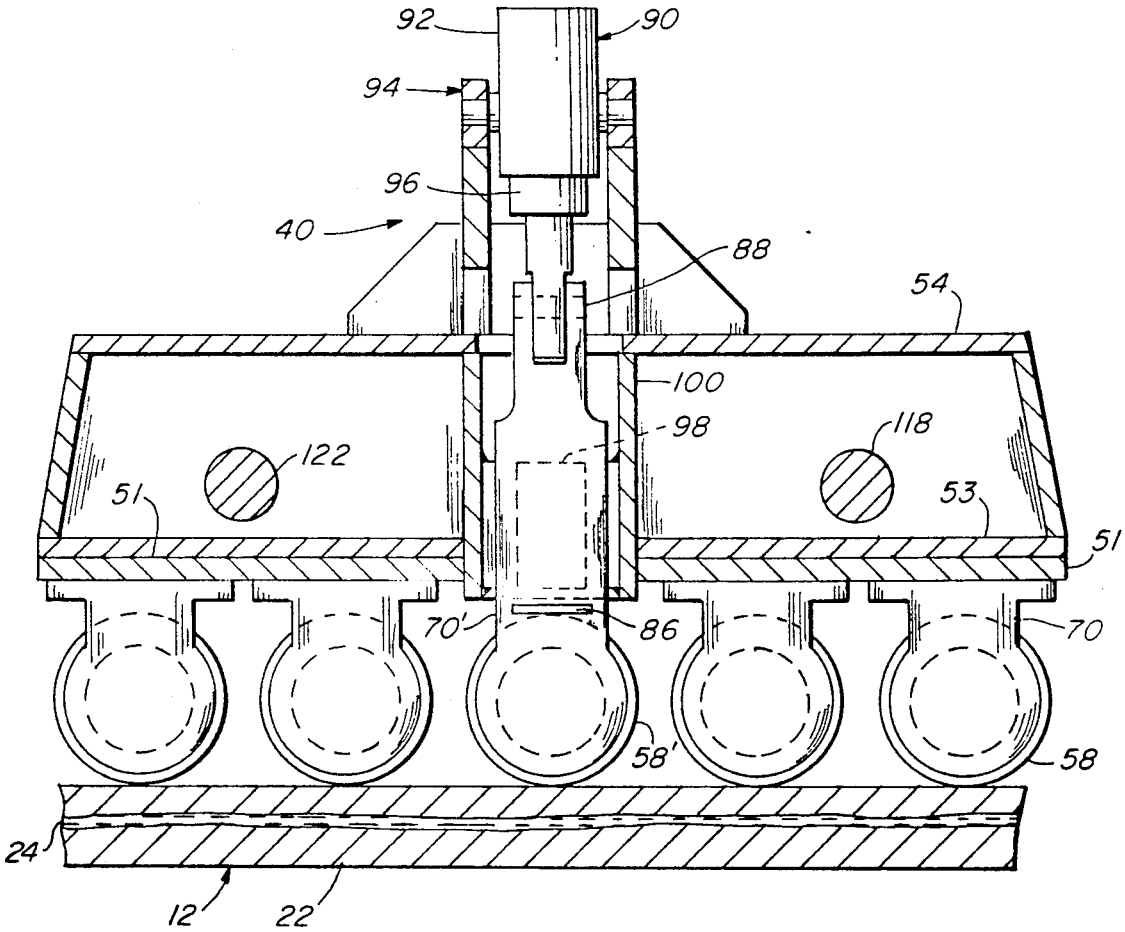
FIG. 6 is a section end view of the guide roll assembly of FIG. 2 taken along line 6—6, generally showing a plurality of second guide rolls, including a pinch roll.

Preferably, the bearing supports 70 (as well as the intermediate supports 68) supporting the second guide rolls 58 are themselves supported by a plurality of longitudinally extending support bars 51 welded to a support plate 53, which is a structural part of the second frame member 54 as shown in FIG. 6. As is conventional, the surfaces of the support bars 51 may be machined and have key slots for receiving and aligning the bearing supports 68, 70 and extending alignment keys (not shown). The first guide rolls are preferably supported in a similar manner.

The intermediate second roll 58', which is a pinch roll, is generally similar to the other second guide rolls 58 but has an extended roll neck 59 (FIG. 5) adapted to be coupled via a coupling 67 and shortened shaft 69 (which permits the pinch roll 58' to be conveniently installed and replaced), universal couplings 72, 74 and a spindle 76 with a gearbox 78 and a motor 80. The pinching second guide roll 58' is supported by an intermediate and two end bearing supports 68' and 70', which are interconnected by cross member 86 (FIG. 6). As is best seen in FIG. 6, the end bearing supports 70' are carried via clevis arrangements 88 by double acting hydraulic piston cylinder assemblies 90. Each assembly 90 has a cylinder member 92 which is rotatably attached to the second frame member 54 by a mounting assembly 94 and has a piston member 96 which is operatively connected with the clevis arrangement 88. Each of the end bearing supports 70' reciprocably moves against four wear plates 98 which are attached to a generally rectangular guide frame 100 welded to the second frame member 54. The second frame member 54 also may have travel stops or limit switches (not shown) for stopping the movement of the pinching second guide roll 58' to prevent it from striking the opposed first guide roll 56'. The first pinch roll 56' may be driven, but is not driven in the described embodiment.

Figure 2:
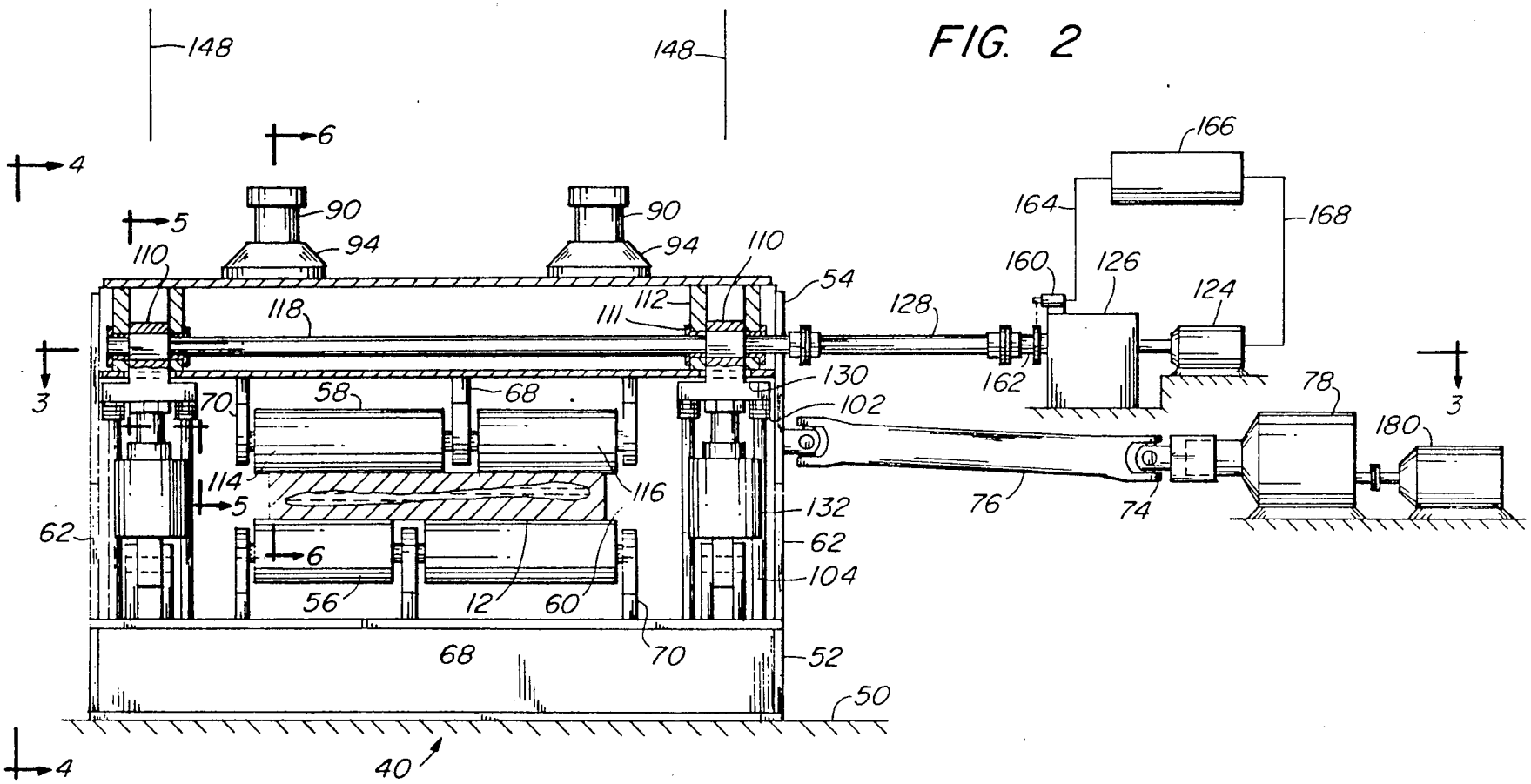
FIG. 2 is a partially sectioned, partially schematic front view of a solidifying metal strand traveling through the roll gap of a guide roll assembly embodying the present invention.
Figure 4:
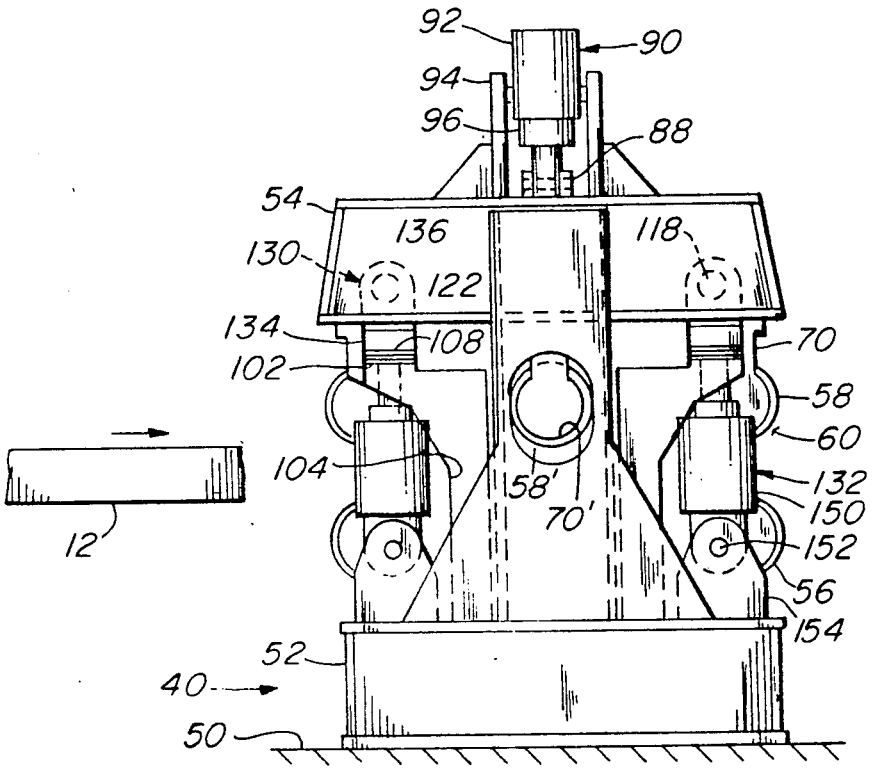
FIG. 4 is a left end view of the guide roll assembly of FIG. 2 taken along line 4—4.
Figure 5:
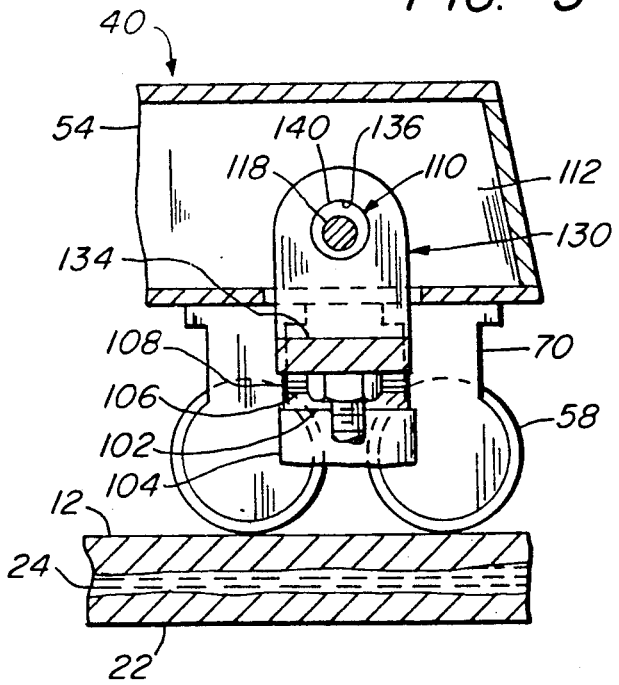
FIG. 5 is a fragmented view of the guide roll assembly of FIG. 2 taken along line 5—5, generally showing a cam engaged with an anchor.

Referring to FIGS. 2, 4 and 5, the first frame member 52 has stops such as the stop pads 102 shown in these FIGS. for stopping the approach of the second frame member 54 toward the first frame member 52. These stops 102 provide a home position for positioning the second frame member 54 relative to the first frame member 52. The stop pads 102 are attached to extending leg members 104 which are welded or otherwise suitably attached to the first frame member 52 such that pad stopping surfaces 106 are located at a known elevation relative to the first frame member. 52 and therefore above the first guide rolls 56. Spacers or shims 108 may be fixed upon the pad surfaces 106 to adjust the effective elevation of the pad stopping surfaces 106 relative to the first frame member 52.

As is best shown in FIGS. 2 and 3, cams 110 are rotatably mounted in solid bearings 111 between two cam support plates 112 extending outwardly from cross plates 113, which are a part of the structure of the second frame member 54. The cams 110 on the exit side of the second frame member 54 near the opposed ends 114, 116 of the second guide rolls 58 are on a first camshaft 118 extending parallel to the axis of the second guide rolls 58. Similarly the cams 110 on the entrance side of the second member 54 near the opposed ends 114, 116 of the second guide rolls 58 are on a second camshaft 122 extending parallel to the axis of the first camshaft 118 and to the axes of the second guide rolls 58. Means for rotating the cams 110, such as an electric motor 124, are operatively connected to the cams 110 through a high reduction gearbox 126 (having a reduction of, e.g., about 1200/1) and a spindle 128. Motors may be operatively connected with one end of the camshafts 118, 122 or with both ends of the camshafts (not shown) in order to positively rotate the cams 110 to a predetermined extent.

Referring to FIGS. 2, 4 and 5, a plurality of anchors 130 and frame clamping means 132 operatively connect the first frame member 52 and the movable second frame member 54. As is best seen in FIGS. 2 and 4, each anchor 130 has a stop engaging means such as a flange 134 for engaging a stop pad surface 106 or a shim 108 on it. Each anchor 130 also has a cam engaging means such as a camming aperture 136 for receiving one of the cams 110 rotatably supported by the second frame member 54. Each cam 110 comprises an eccentric disk 140 which is generally cylindrical and (in the shown assembly) has an eccentricity of about 0.75 mm (0.030 inches) relative to its shaft for casting a 250 mm strand. Thus a 180° rotation of cams 110 may effect a maximum relative displacement of about 1.5 mm (0.06 inch) of the second frame member 54 relative to the first frame member 52. Lesser displacements are a function of the angle of rotation. The cams 110 may be designed for any eccentricity but must, of course, be designed to transmit very large forces between the second frame member 54 and the first frame member 52 which may be on the order of hundreds of thousands of pounds of force.

Frame clamping means such as conventional hydraulic piston cylinder assemblies 132 (FIGS. 2 and 6) urge the flanges 134 of the anchors 130 operatively connected with the second frame member 54 against the stops 102 of the first frame member 52 for positioning the second frame member 54 relative to the first frame member 52 and thereby establishing a nominal roll gap 60 between the opposed pairs of first and second guide rolls 56, 58 mounted on them. As shown in FIGS. 2–4, the piston 146 of each clamping piston cylinder assembly 132 is connected to an anchor 130 in a plane 148 (FIG. 2) which extends through a cooperating cam 110 perpendicular to the pass line The cooperating cylinder 150 is rotatably coupled by a pin 152 (FIG. 4) extending through the same perpendicular plane 148 to a mounting assembly 154 attached to the first frame member 52. Preferably the frame clamping piston cylinder assemblies 132 are double acting so that the guide roll assembly 32 can be readily set up. As FIG. 5 best shows, the parallel planes 148 generally including the cams 110 also extend between two closely spaced anchor flanges 134 and stop pad surfaces 106.

Preferably, means are provided for adjusting the roll gaps 60 while a strand 12 is traveling through the roll guide assembly 32. Thus a pulse generator or other position resolver 160 (FIG. 3) such as are commercially available from Advanced Micro Controls, Inc. and other commercial sources senses the position of the output shaft 162 of the high reduction gearbox 126 and outputs a corresponding signal on line 164 to a computing device 166 such as a computer or microprocessor (which may have other inputs) for controlling the camming motor 124. The computing device 166, under manual or programmed control or control of a supervisory device, then outputs a signal on line 168 to the camming motor 124 to control the rotation of the cams 110.

As FIG. 3 shows, the cams 110 and cam rotating assembly on the entrance side of the frame segment 40 are operated separately from the cams 110 and cam rotating assembly on the exit side of the frame segment 40. Thus the second frame member 54 can readily be inclined relative to the first frame member 52 to present a taper line to a shrinking strand traveling through the roll gaps 60. Alternatively the second frame member 54 ca be positioned parallel to the first frame member 52 to present series of uniform roll gaps 60 to a dimensionally stable traveling strand 12. Also the roll gaps 60 may, if desired, be adjusted to provide a soft reduction.

In the practice of the present invention, the frame clamping piston cylinder assemblies 132 first move the second frame member 54 away from the first frame member 12 so that spacers or shims 108 can be inserted on or removed from the surfaces 106 of the stop pads 102. The frame clamping piston cylinder assemblies 132 then move the second frame member 54 toward the first frame member 52 until the anchor flanges 134 are stopped by the stop pads 102 extending from the first frame member 52 to position the second frame member 54 and thereby establish a nominal roll gap dimension. If necessary, middle second (pinch) roll 58' is moved toward the first frame member 52 in order to drive a usually narrow starter bar (not shown) to or from the casting mold 18. The pinch roll 58' is then moved away from the first frame member 52 to a position corresponding to the appropriate roll gap. Either before or while the strand 112 is traveling through the guide roll assembly 32, the cams 110 are rotated to reposition the second frame member 54 and the second rolls 58 mounted on it for adjusting the nominal roll gap dimensions. With computer control, the cams 110 of frame segments 34, 36, 38, 40 may be readily adjusted simultaneously. The cams 110 may be repeatedly rotated during a casting campaign to readjust to changing process conditions as needed.

The roll gaps 60 of the guide roll assembly 32 may be set to present a taper line to a solidifying metal strand 12 to continuously support both faces of a shrinking strand and/or to effect a soft reduction of a solidifying strand.

Depending upon the metal and its thickness, the guide roll assembly may also be employed to effect a soft reduction upon a solidified strand near its melting range.

While a presently preferred embodiment of the present invention has been shown and described, it is to be distinctly understood that the invention is not limited thereto but may be otherwise variously embodied within the scope of the following claims.

What is claimed is:

1. A guide roll assembly for guiding a metal strand traveling from a casting mold through a series of roll gaps defined by pairs of generally opposed guide rolls, comprising:

a frame segment having a first frame member and a second frame member;

parallel first guide rolls mounted on the first frame member, the first frame member having stops;

second guide rolls spaced from and parallel to the first guide rolls, the second guide rolls mounted on the second frame member;

cams on camshafts, the camshafts rotatably mounted on the second frame member;

a plurality of anchors, each anchor having stop engaging means for engaging one of the stops and having cam engaging means for anchoring one of the cams rotatably mounted on the second frame member;

frame clamping means operatively connected with the anchors and with the first frame member for urging the stop engaging means against the stops and thereby positioning the second frame stop engaging means against the stops and thereby positioning the second frame member relative to the first frame member and establishing nominal roll gap dimensions between the opposed guide rolls mounted on them; and cam rotating means operatively connected with the cams rotatably mounted on the second frame member and anchored to the first frame member for rotating the cams and thereby repositioning the second frame member and the second guide rolls mounted thereon relative to the first frame member and the first rolls mounted on it and adjusting the nominal roll gap dimensions.

2. The guide roll assembly of claim 1, comprising two cams disposed on a first camshaft extending parallel to the second guide rolls with one of the cams near to one end of the second guide rolls and the other cam near to the other end of the second guide rolls; and two cams disposed on a second camshaft which is spaced from the first camshaft and parallel to the second guide rolls with one of the two cams near to one end of the second guide rolls and the other cam near to the other end of the second guide rolls.

3. The guide roll assembly of claim 2, wherein a first cam rotating means is operatively connected with the cams disposed on the first camshaft and a second cam rotating mean is operatively connected with the cams disposed o the second camshaft whereby the camshafts may be rotated to different extents for providing different roll gaps between the pairs of guide rolls.

4. The guide roll assembly of claim 3, comprising a plurality of frame segments.

5. The guide roll assembly of claim 2, wherein at least one of the second guide rolls is driven by a motor.

6. The guide roll assembly of claim 1, further comprising position resolvers operatively attached to the cam rotating means and associated with computing means for controlling the cam rotating means.

7. A method for guiding a solidifying metal strand length traveling from a continuous casting mold through roll gaps defined by a series of opposed guide rolls, comprising the steps of:

positioning the guide rolls of opposed pairs of guide rolls for establishing nominal roll gap dimensions between the opposed guide rolls;

camming one of the guide rolls of each pair of opposed guide rolls for adjusting the roll gaps; and passing a partially solidifying strand length through the adjusted roll gaps in contact with opposed pairs of first rolls and second rolls.

8. The method of claim 7, wherein the roll gaps are adjusted while a partially solidified strand length is passing therethrough.

9. The method of claim 7, including the step of reducing the thickness of a solidifying metal strand length.

10. The method of claim 9, wherein the roll gaps are adjusted while a partially solidified length is traveling therethrough.

11. The method of claim 8, wherein the roll gaps are adjusted to present a taper line to the solidifying metal strand.

12. A guide roll assembly for guiding and evenly supporting a soiling metal strand traveling from a continuous casting mold through a plurality of roll gaps defined by a series of sets of opposed, parallel pairs of guide rolls, comprising:

a plurality of first guide rolls in each set mounted on a first frame member, the first frame member having stops thereon;

a plurality of second guide rolls in each set spaced from and parallel to each of the first guide rolls in the set;

cams rotatably mounted on the second frame member in each set;

a plurality of anchors in each set, each anchor having stop engaging means for engaging a stop on the first frame member in the set and having can engaging means for anchoring one of the cams rotatably mounted on the second frame member in the set to the corresponding first frame member;

frame clamping means in each set operatively connected with the anchors and with the first frame member in the set for urging the stop engaging means against the corresponding stops and thereby positioning the corresponding second frame member relative to the first frame member and establishing a nominal roll gap dimension between the set guide rolls mounted on them, and cam rotating means operatively connected with the cams mounted on the second frame member in each set for rotating the cams and thereby repositioning the corresponding second frame member and the second guide rolls mounted on it relative to the corresponding first frame member the first guide rolls mounted on it and thereby adjusting the corresponding nominal roll gap dimension.

13. The guide roll assembly of claim 12, wherein the cams rotated about axes extending parallel to the second rolls in each set of guide rolls.

14. The guide roll assembly of claim 13, wherein at least two cams are disposed on a camshaft extending parallel to the second guide rolls in each set of guide rolls, with one of the cams being located near one end of the second guide rolls of the set and a second cam being located near the other end of the second guide rolls of the set.

15. The guide roll assembly of claim 14, comprising two spaced apart camshafts in each set of guide rolls and wherein each of the camshafts extends parallel to the second guide rolls in the set, each shaft having cams disposed near the respective ends of the second guide rolls.

16. The guide roll assembly of claim 12, further comprising a position resolver operatively attached to the cam rotating means in each set of guide rolls and associated with a computing device actuated by the position resolver and controlling rotation of the cam rotating means in accordance with the portion of the position resolver.

17. The guide roll assembly of claim 16, wherein at least one of the second guide rolls in each set is driven by a motor.

18. The guide roll assembly of claim 17, wherein more than two second guide rolls are mounted on the second frame member of each set of guide rolls and all but one of the second guide rolls are not driven.

* * * * *